United States Patent [19]

Renaud

[11] Patent Number: 5,050,306

[45] Date of Patent: Sep. 24, 1991

[54] WALLPAPER BORDER MARKER/CUTTER DEVICE

[76] Inventor: Fredric T. Renaud, R.D. #2, Box 202E Sunset Dr., Basking Ridge, N.J. 07920

[21] Appl. No.: 691,506

[22] Filed: Apr. 25, 1991

[51] Int. Cl.[5] ..... B26B 1/08

[52] U.S. Cl. ..... 30/293; 30/294; 33/41.1; 33/41.5

[58] Field of Search ..... 30/286, 293, 294, 290; 33/32.2, 41.1, 41.5, 42

[56] References Cited

U.S. PATENT DOCUMENTS

| | | | |
|---|---|---|---|
| 2,007,395 | 7/1935 | Howard . | |
| 2,044,426 | 6/1936 | Gelleff | 30/293 |
| 2,601,183 | 6/1952 | Unsinger . | |
| 2,641,834 | 6/1953 | Bobrowski et al. . | |
| 2,880,506 | 4/1959 | Zimmerman | 30/293 |
| 3,885,315 | 5/1975 | Polselli et al. | 33/42 |
| 4,077,124 | 3/1978 | Christmann | 30/293 X |
| 4,501,069 | 2/1985 | Kohno | 30/293 |
| 4,868,989 | 9/1989 | Renaud | 30/293 |
| 4,903,409 | 2/1990 | Kaplan | 33/42 X |

*Primary Examiner*—Douglas D. Watts
*Attorney, Agent, or Firm*—Kenneth P. Glynn

[57] ABSTRACT

The present invention is directed to a wallpaper border marker-cutter device which is used for marking walls for borders and/or for trimming wallpaper, at a preselected level below a ceiling. The device includes a base which has a substantially flat face surface and is of adequate thickness to support wheels. Additionally, it has a protruding member extending outwardly from the face surface for receiving a slidable combination marker and blade holder(s). There is a first plurality of wheels mounted on the base in a plane at about 90 degrees to the face surface of the base for rolling the device along a wall as well as a second plurality of wheels mounted on the base plane parallel to the face surface of the base for rolling the device along a ceiling and in combination with the first plurality of wheel for rolling the device simultaneously along a wall and a ceiling. The device also includes a blade holder mounting slot and a marker or marking instrument holding slot which are located on the protruding member for slidably mounting.

15 Claims, 3 Drawing Sheets

WALLPAPER BORDER MARKER/CUTTER DEVICE

BACKGROUND OF THE INVENTION

1. Field of the Invention

The present invention is directed to wallpaper border marker-cutters and more particularly to such devices which enable the user to make even, smooth lines or marks on walls as well as even, smooth cuts in wallpaper for subsequent hanging of a wallpaper border. Thus, the present invention device is a tool for simplifying and increasing the efficiency of hanging wallpaper borders on painted surfaces by enabling the user to properly mark the walls for signing and/or preadhesive application. It is also directed to simplifying and increasing the efficiency of hanging wallpaper which includes separately hangable borders.

2. Prior Art Statement

Mechanical cutters have been known for many decades and have been designed to facilitate the speed with which users cut various materials as well as to aid in determining particular width, depths or other dimensions of cutting. Thus, in general, the prior art describes implements for cutting linoleum, cardboard, paperboard, wood and the like and the prior art is exemplified by U.S. Pat. Nos. 2,007,395 to George O. Howard; 2,601,183 to Phillip H. Unsinger; 2,641,834 to Stanley F. Bobrowski et al.; 2,880,506 to Charles H. Zimmerman. Each of these patents show various types of cutting implements which basically are designed to slide along an edge of a board or linoleum or the like and have a blade holder. In most cases, the devices also include means for adjusting the cutting widths. Regarding the art of specifically cutting wallpaper and devices for paperhanging in general, the art is typified by U.S. Pat. Nos. 2,004,426 issued to Arthur Gelleff; 4,077,124 issued to Norbert Christmann; and 4,501,069 issued to Seiji Kohno. These patents show various types of devices for holding a blade in place with sliders or alignment possibilities designed to allow the operator to cut straight lines of desired widths.

U.S. Pat. No. 4,868,989, issued to Fredric Renaud, the present inventor herein, on Sept. 26, 1989, describes in detail a wallpaper border cutting device which simultaneously travels along a wall and a ceiling with an adjustable blade to be preset a selected distance from the ceiling. However, notwithstanding this or any of the cited prior art, no prior art patent teaches or renders obvious the device of the present invention which calls for a unique scribing and cutting device which travels simultaneously along a wall and a ceiling on free spinning wheels and yet has the option of inserting a marking instrument and/or a cutting blade which may be adjusted to a selected distance from the ceiling and which is held in place for smooth parallel marking or cutting so as to enable the user to rapidly glide across a wall or hung wallpaper to mark the wall or cut and remove the top portion of wallpaper to create an even edge for abutment with a separately hung wallpaper border which will meet flush with the wallpaper in the same plane. Further, in a preferred embodiment of the present invention, the holder is slidably removable and may be reversed so the device may be moved along a wall from left to right or from right to left, either to allow left handed or right handed person to use it comfortably or to permit reversible directions in awkward locations.

SUMMARY OF THE INVENTION

The present invention is directed to a wallpaper border marker-cutter device which is used for marking walls for borders and/or for trimming wallpaper, at a preselected level below a ceiling. The device includes a base which has a substantially flat face surface and is of adequate thickness to support wheels. Additionally, it has a protruding member extending outwardly from the face surface for receiving a slidable combination marker and blade holder(s). There is a first plurality of wheels mounted on the base in a plane at about 90 degrees to the face surface of the base for rolling the device along a wall as well as a second plurality of wheels mounted on the base in a plane parallel to the face surface of the base for rolling the device along a ceiling and in combination with the first plurality of wheel for rolling the device simultaneously along a wall and a ceiling. The device also includes a blade holder mounting slot and a marker or marking instrument holding slot which are located on the protruding member for slidably mounting. In one preferred embodiment, a blade holder may be removably and slidably mounted in a blade holder mounting slot. A locking mechanism is connected to the protruding member so as to permit temporary locking of the holder at a preselected location along the device. A blade receiver and clamping mechanism is attached to the blade holder and located to receive a blade in a clamped position so that a cutting edge would extend into a cutting slot located on the base.

BRIEF DESCRIPTION OF THE DRAWINGS

The invention will be more fully understood by referring to the following detailed specification, the above specification, and the claims set forth herein, when taken in connection with the drawings attached hereto, wherein:

DETAILED DESCRIPTION OF THE INVENTION

The present invention is directed to efficient, accurate hanging of wallpaper type borders. It is useful in both the application of such borders to painted or other unpapered walls as well as to papered walls. The present invention device is used for marking walls for signing them for border hanging. It is also used for the cutting of prehung wallpaper for removal of irregular top edges and for creation of space against portion of the wallpaper for the subsequent hanging of a separate wallpaper border strip. The present invention is directed to the simultaneous movement of the device along both a wall and a ceiling while providing for a marker and/or cutting blade which is slidably adjustable and removable and which, in its preferred embodiments, may be reversed for either left hand use or right hand use.

Figure 1:
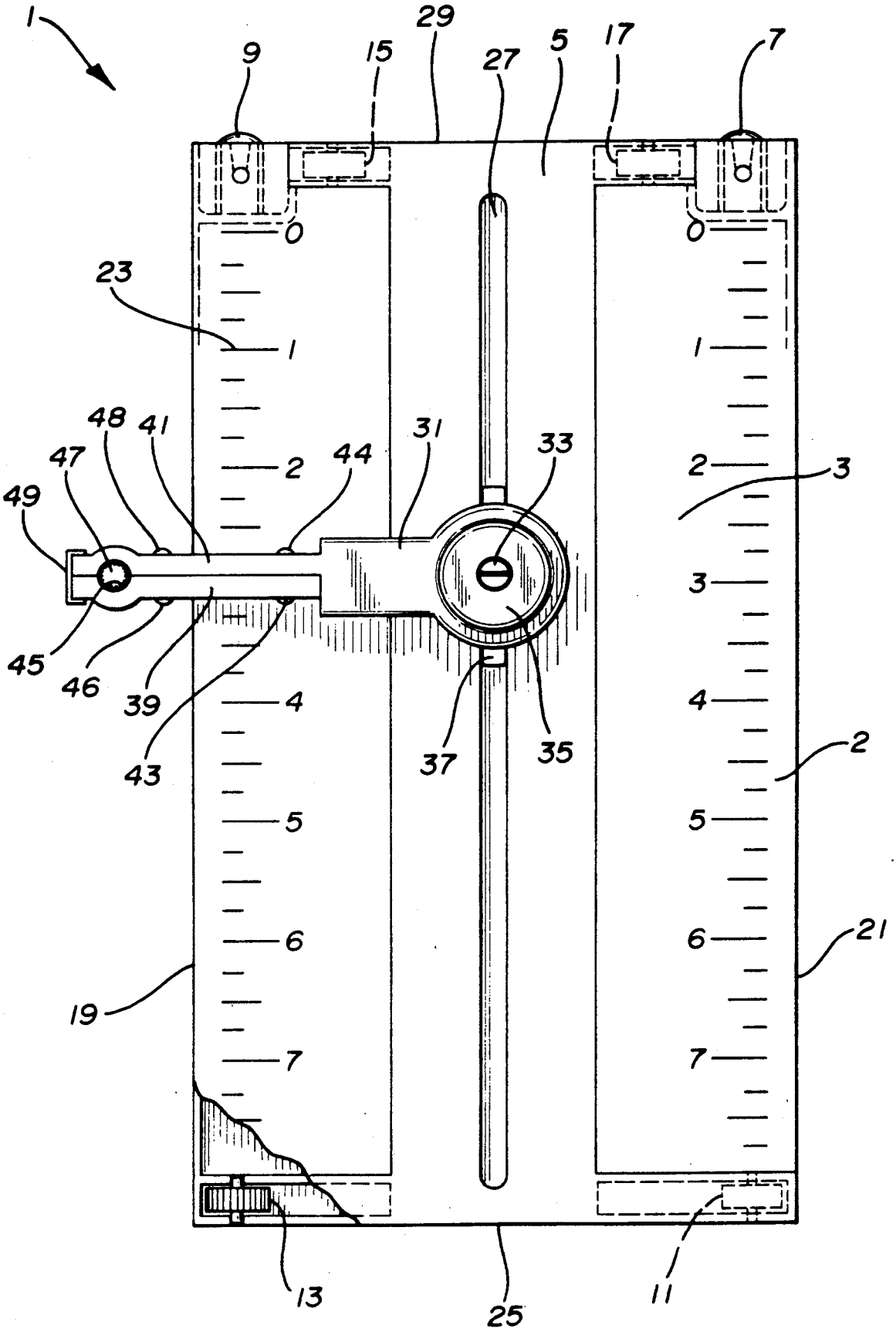
FIG. 1 illustrates a top view or a face surface view of the present invention cutter device.

Referring now to FIG. 1, there is shown present invention marker-cutter device 1 for marking walls and for trimming wallpaper at a selected level below a ceiling. It includes a base 2 having a substantially flat face surface 3 which is of adequate thickness to support wheels as shown. Base 2 also has a protruding member 5 which extends outwardly from said face surface 3 for receiving a slidable marker/blade holder 31. A first plurality of wheels, in this case wheels 11, 13, 15 and 17 are mounted on said base in planes at about 90 degrees to the face surface 3, as shown, for rolling the device along a wall. A second plurality of wheels 7 and 9 are mounted on the base 2 in a plane parallel to face surface 3 for rolling the cutter device 1 along a ceiling. Thus, first plurality of wheels 11, 13, 15 and 17 and second plurality of wheels 7 and 9, when working together, enable one to simultaneously move the device in a gliding, smooth fashion along both a wall and a ceiling parallel to the wall surface and to the ceiling surface. A mounting slot 27 is located on protruding member 5 for slidably mounting holder 31, as shown. At least one cutting slot is located on base 2 as shown although a plurality of such slots may be utilized without exceeding the scope hereof. For example, they may be located in parallel and on opposite sides of protruding member 5 on face surface 3 of base 2.

It should be that the present invention may utilize a slidable holder in place of holder 31 which would in effect be two holders in tandem or piggybacked. For example, referring to FIG. 1, holder 31 may be redesigned to exclude the marker holder 45 as it is presently located. A different marker holder could be added onto an extension such as an addition to the safety flip cover without exceeding the scope of the present invention.

Figure 2:
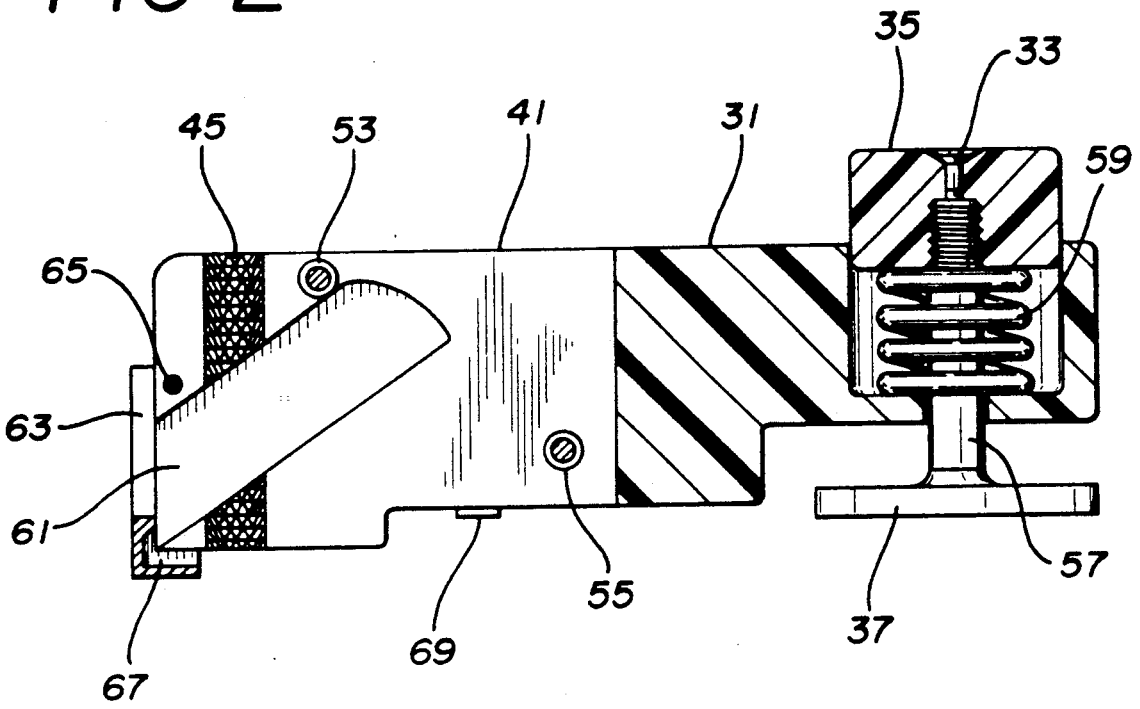
FIG. 2 shows a side cut view of a part of the device of the present invention.

Referring now to FIG. 2, there is a side cut view showing holder 31 with dial 35, shaft 57 and base 37. As shown in FIG. 1, base 37 rides under slot 27 of protruding member 5. Spring 59 in conjunction with dial 35 is used to clamp down holder 31. Parallel plate 41 includes screw orifices 53 and 55 as well as blade holder indentation 61 and pencil holder 45 with serrations or other gripping means. Parallel plate 39 would be the mirror image of plate 41. Bottom serrations 69 are strategically located so as to cooperate with raised indicia such as numeral 23 on flat surface 3. Saftey flip cover 63 has a recess 67 to protect a blade when not in use and is hingedly connected to holder 31 at pivot point 65.

Referring now, simultaneously to FIGS. 1 through 4, note that holder 31 includes a locking mechanism consisting of parallel plates 39 and 41 which are squeezed by screw 43 and screw receiver 44 by rotation of screw 43 through orifice 55. Likewise, screw 46 and receiver 48 operate similarly in orifice 53. Thus, a blade or a pencil may be received and clamped in a fixed fashion until the blade or pencil needs to be replaced by the tightening screws as shown.

Figure 3:
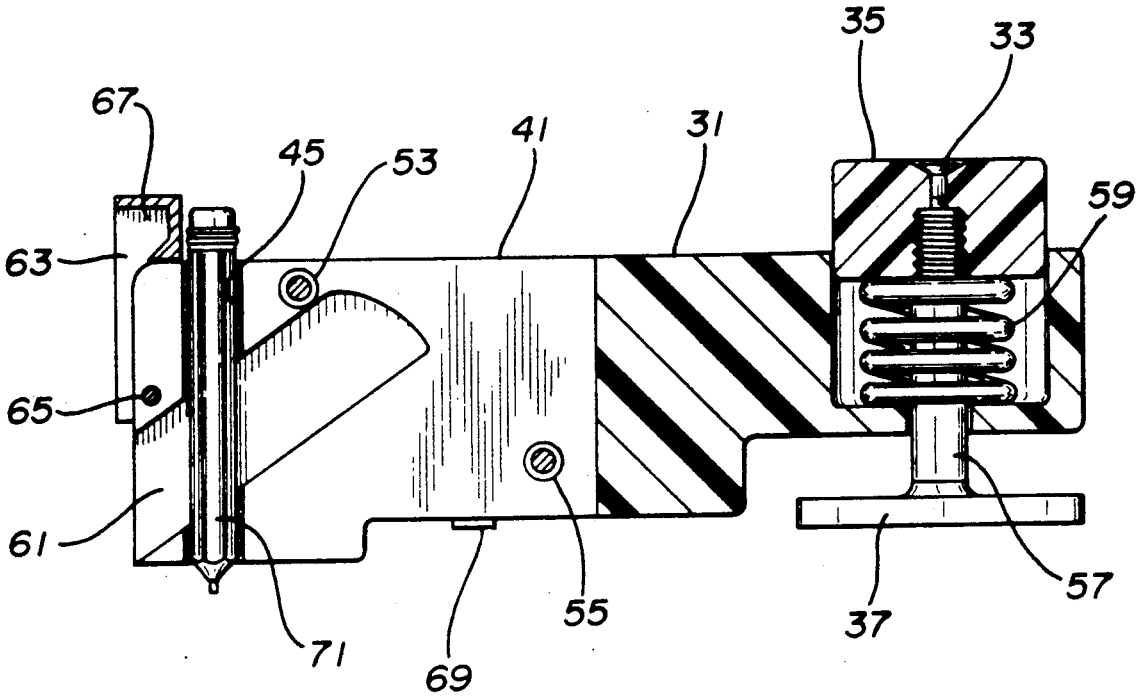
FIG. 3 and FIG. 4 show the FIG. 2 device holder loaded with razor and marker respectively; and, FIG. 5 shows an alternative embodiment with slider protrusion tips.
Figure 4:
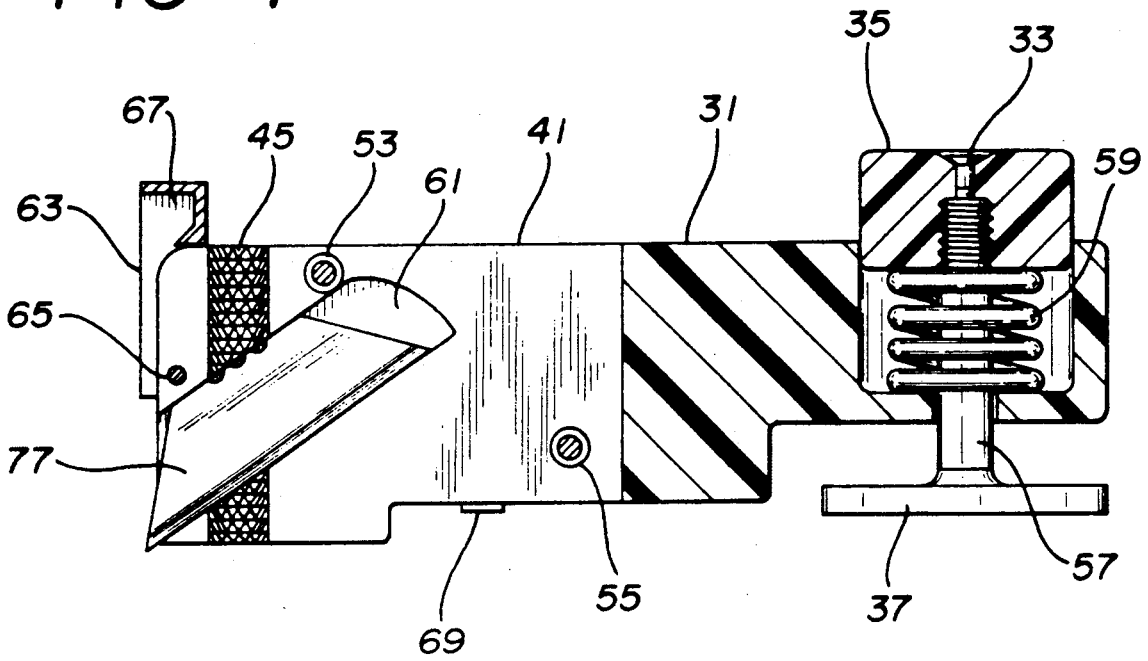

As illustrated more precisely by FIGS. 3 and 4 pencil 71 and cutting blade 77 are set for drawing lines or cutting wallpaper at a preselected distance below a ceiling. The pencil or blade cutting edge extend below the wheels 11, 13, 15 and 17 and below base 2. Graduations and numerals, typified by numeral 23, shown in FIG. 1 enable the user to more accurately preselect a blade or pencil location which would identify exactly the distance from a ceiling to the blade or pencil when device 1 is positioned up against a wall and a ceiling whereby wheels 7 and 9 touch a ceiling and wheels 11, 13, 15 and 17 touch a connecting wall.

Figure 5:
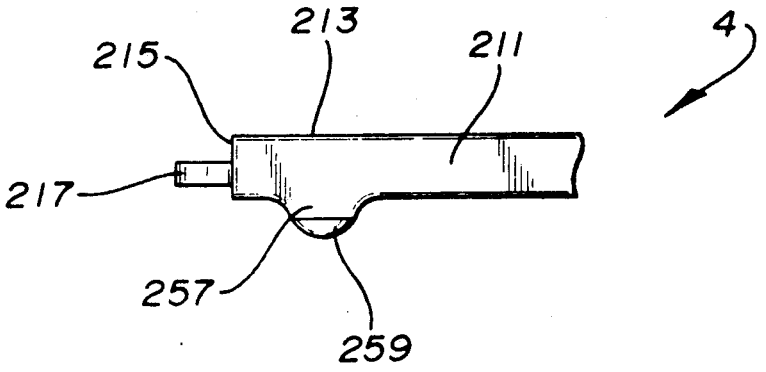

Referring to FIG. 5, there is shown a side partial cut view of a base 211 of a device 4 having a flat top surface 213 and end 215. Shown at end 215 is wheel 217 for rolling along a ceiling and is equivalent to wheel 9 of device 1 of FIG. 1. There are also a plurality of slider protrusions such as protrusion 257 and protrusion end 259 (FIG. 5). As shown in FIG. 5, slider protrusion ends typified by Teflon end 259 along with the wheels act in harmony to permit smooth rolling of the cutter device along a wall.

The particular marker blade holder, as well as blade receiver and clamping mechanism, is a matter of choice by the artisan and alternative techniques may be employed which are known and which are shown in the prior cited above, without exceeding the scope of the invention. For example, the device of the present invention may have the marker holder at a location separate from the blade holder, e.g., at the side end or the holder so that both could be held and protraction-extension could be included to offer the user a choice. Likewise, the particular shape of the protrusion 5 of the device is a matter of design and may be rectilinear, cylindrical, or may even include some irregular shapes such as indentures for grasping. It may have one slot or a number of parallel slots. Also, note that the protruding member 5 is of significant proportions and should be of significant strength for a user to use that protruding member 5 as a handle in addition to a mounting mechanism for the blade holder. Also, the particular types of dimensions and the exact length or width of the device is of no significance. Further, the type of wheels chosen may be the disc type wheels shown, or may be mounted roller type wheels, bearings, or other sliders.

Additionally, the glider protrusion tips which are used in place of some of the wall contact wheels may be unistructurally molded into the device or may be partially molded into the device with inserted tips such as plastic, rubber, teflon or other material, or may be stationary, slider, roller, or ball type attachments, collectively herein referred to as slider protrusion tips.

The particular choice of material for producing the present invention device is a matter of choice. However, the device may readily be fabricated out of pressed metal or heavy duty molded plastic and the wheels may be plastic, metal, or non-marking rubberized material. The blade holder may be designed to receive single edged trapezoidal type professional cutting blades or to receive conventional shaving blades, either double edged or single edged and may or may not be designed to receive both of these types of blades, without exceeding the scope of the present invention. The marker holder may likewise be developed to hold a pencil, or to hold a marker or chalk.

Obviously, numerous modifications and variations of the present invention are possible in light of the above teachnings. It is therefore understood that within the scope of the appended claims, the invention may be practiced otherwise then as specifically described herein.

What is claimed is:

1. A wallpaper border marker and cutter device for marking walls and for trimming wallpaper at a preselected level below a ceiling, which comprises:

(a) a base having a substantially flat face surface, and having a protruding member extending outwardly from said face surface for receiving a slidable blade holder;

(b) a first plurality of wheels mounted on said base in planes at about 90 degrees to said face surface of said base for rolling the cutter device along a wall;

(c) a second plurality of wheels mounted on said base in a plane parallel to said face surface of said base for rolling the cutter device along a ceiling, and, in combination with said first plurality of wheels for rolling said cutter device simultaneously along a wall and a ceiling;

(d) at least one holder mounting slot located on said protruding member for slidably mounting a holder;

(e) a blade holder removably and slidably mounted in said holder mounting slot, said holder adapted to receive and hold at least one cutting blade;

(f) a marker holder adapted to receive at least one marking device and being connectively related to said blade holder for said cutting blade;

(g) a locking mechanism connected to said marker holder and said holder mounting slot so as to permit temporary locking of said blade holder at a preselected location along said plurality of parallel blade holder mounting slots; and, (h) a blade receiver and clamping mechanism attached to said blade holder and located such that a blade clamped therein could have a cutting edge extend beyond said blade receiver.

2. The device of claim 1 wherein graduated marks are set forth thereon for more accurate preselection of a blade location.

3. The device of claim 2 wherein said graduated marks are raised.

4. The device of claim 2 wherein said graduated marks include distance measurements which indicate distance from a ceiling when said first plurality of wheels is located against a wall and said second plurality of wheels is located against a ceiling.

5. The device of claim 1 wherein said blade receiver and clamping mechanism is a screw and parallel plate mechanism which may be opened and closed by screw rotation to receive and clamp a blade.

6. The device of claim 1 wherein said blade holder further includes a blade safety cover which may be repositioned from covering a blade to exposing a blade for use.

7. The device of claim 6 wherein graduated marks are set forth thereon for more accurate preselection of a blade location.

8. The device of claim 6 wherein said graduated marks are raised.

9. The device of claim 6 wherein said graduated marks include distance measurements which indicate distance from a ceiling when said first plurality of wheels is located against a wall and said second plurality of wheels is located against a ceiling.

10. The device of claim 6 wherein said blade receiver and clamping mechanism is a screw and parallel plate mechanism which may be opened and closed by screw rotation to receive and clamp a blade.

11. The device of claim 3 wherein said blade holder includes serrations on its underside to further locking wherein the serrations cooperate with said graduated marks.

12. The device of claim 11 wherein said graduated marks include distance measurements which indicate distance from a ceiling when said first plurality of wheels is located against a wall and said second plurality of wheels is located against a ceiling.

13. The device of claim 11 wherein said blade receiver and clamping mechanism is a screw and parallel plate mechanism which may be opened and closed by screw rotation to receive and clamp a blade.

14. The device of claim 11 wherein said blade holder further includes a blade safety cover which may be repositioned from covering a blade to exposing a blade for use.

15. The device of claim 1 wherein said blade holder for said cutting blade and said marker holder for said marking device are combined into a single holder.

* * * * *